United States Patent [19]

Spinner

[11] 3,976,352

[45] Aug. 24, 1976

[54] COAXIAL PLUG-TYPE CONNECTION

[76] Inventor: Georg Spinner, Am Eichberg 12, 8152 Feldkirchen-Westerham 1, Germany

[22] Filed: Apr. 29, 1975

[21] Appl. No.: 572,906

[30] Foreign Application Priority Data

Dec. 16, 1974 Germany ..... 2459429
May 2, 1974 Germany ..... 2421321

[52] U.S. Cl. ..... 339/177 R; 339/61 R; 339/94 R

[51] Int. Cl.[2] ..... H01R 17/18

[58] Field of Search ..... 339/42, 60 R, 60 C, 339/60 M, 61 R, 61 M, 94 R, 94 M, 177 R, 177 E

[56] References Cited

UNITED STATES PATENTS

| | | | |
|---|---|---|---|
| 513,949 | 1/1894 | Munson | 339/94 R |
| 3,439,294 | 4/1969 | Flanagan | 339/177 R |
| 3,491,326 | 1/1970 | Pfister | 339/42 |
| 3,657,681 | 4/1972 | Falkner | 339/177 R |
| 3,792,418 | 2/1974 | Kailus | 339/177 R |

FOREIGN PATENTS OR APPLICATIONS

| | | | |
|---|---|---|---|
| 1,946,158 | 3/1971 | Germany | 339/94 R |

*Primary Examiner*—Roy Lake
*Assistant Examiner*—Mark S. Bicks
*Attorney, Agent, or Firm*—Ostrolenk, Faber, Gerb & Soffen

[57] ABSTRACT

A sealed coaxial cable plug type connection in which the cavity between the inner and outer conductors of each cable connected is filled in the vicinity of the plug contacts with dielectric material; the shaping and resiliency of the dielectric material properly seals the connection; additional means to seal and hold the connection together.

19 Claims, 8 Drawing Figures

COAXIAL PLUG-TYPE CONNECTION

The invention relates to a sealed coaxial plug-type connection in which the cavity between the outer and inner conductor is filled in the immediate vicinity of the plug contacts with dielectric material.

Such coaxial plug-type connections, in particular cable connectors and associated housing connectors which are used in the open air, must have a construction which ensures that they function regardless of the weather. For this purpose, the plug-type connection, i.e. the contact area from the inner to the outer conductor, was protected by suitable sealing means form the penetration of water or the like. For this purpose the sealing was provided outside the outer conductor contact with the aim of preventing both the outer conductor contact and the inner conductor contact from coming into contact with water or any increase in moisture in the cavity between the outer and inner conductors. The sealing measures employed for this purpose are extremely complicated in their construction. They require tensioning or clamping members which generally by axial bracing deform sealing rings or the like in such a manner that a sealing is produced.

Difficulties also result from the inevitable aging of the seals or from a flowing of the sealing material if the corresponding clamping pressure was exceeded.

Filling the space between the inner and outer conductors also in the immediate vicinity of the plug contacts with a dielectric material was intended to prevent appreciable impairment of the electrical properties due to the penetration of moisture or water, which cannot be avoided with certainty.

The invention is based on the problem of providing a simplified coaxial plug-type connection which guarantees that the desired transfer properties are retained even when used under unfavourable weather conditions without the need for complicated clamping means and seals outside the outer conductor contact.

According to the invention, this problem is solved in that the dielectric material between the inner and outer conductors effects the mutual sealing in the plugged-in state. The dielectric composition thus effects a sealing of the plug inner space, i.e. the plug area of the inner conductor is sealed and furthermore protection is guaranteed against the penetration of dust and moisture at least to the extent which excludes any interference in the highfrequency transfer. This mutual sealing is effected according to the invention by the shaping of the dielectric material on the one hand and the resiliency thereof on the other, thereby effecting a complete sealing in the plugged-in state.

The resiliency may be achieved on the one hand by resilient construction of the contact socket or contact plug, whereby the dielectriic material in the plugged-in state is pressed against each other and against the adjacent conductor surfaces to such an extent that the necessary seal is obtained.

According to a further development of the invention the problem set is solved in that onto the contact socket a resilient ring is drawn which is axially compressible by end ring faces of the outer conductors. In this manner the penetration of dirt and dust as well as moisture to the inside is reliably prevented.

A further problem in plugs of this type is that prior to the plugging together dirt, dust or moisture can penetrate the inner conductor socket without this being apparent to the filter so that in the plugged-in state there is no guarantee of satisfactory inner conductor contact. To prevent the penetration of foreign bodies, according to a further development of the invention in the interior of the inner conductor socket a metal or plastic stopper or plug is disposed which is supported in the axial direction by a helical spring and urged towards the open end so that in the unplugged condition it seals the socket. In the case of a slit spring socket an adequate sealing pressure can be obtained by the radially resilient segments. On insertion of the inner conductor plug pin the stopper is automatically pressure back so that the radial resiliency of the spring is released and a contacting established to the inner conductor pin. On separation of the plug-type connection the spring again urges the stopper forwardly and the socket is protected from the penetration of dirt. At the same time, a cleaning effect is produced. According to a further development of the invention for the stopper a form-locking stop is provided which prevents the stopper from being pressed out of the socket. For this purpose, the spring segments of the receptacle or socket may be provided with thickened ends which guarantee a defined contacting at this point with the inserted inner conductor plug pin.

Some examples of embodiment of the invention will be described hereinafter with the aid of the drawings, wherein.

Figure 1:
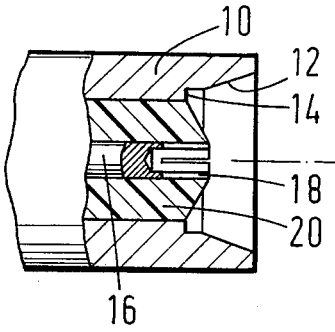
FIG. 1 is a schematic sectional view of a socket or receptacle member of a coaxial plug-type connection according to the invention.

According to the examples of embodiment illustrated the socket outer conductor 10 is made rigid and provided with a conical insertion funnel 12 and an axial contact step 14. The associated inner conductor 16 of the socket member comprises a resilient socket consisting of spring tongues 18. The dielectric 20 between the inner conductor 16 and the outer conductor 10 is formed conically at its free end face and extends from the contact ring step 14 to the axially forwardly disposed end of the contact sockets 18 of the inner conductor.

Figure 2:
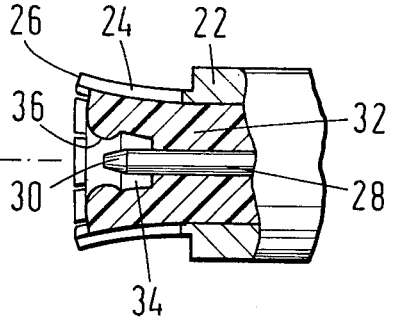
FIG. 2 is a sectional view of a first embodiment of a pin member which fits the socket member according to FIG. 1.
Figure 3:
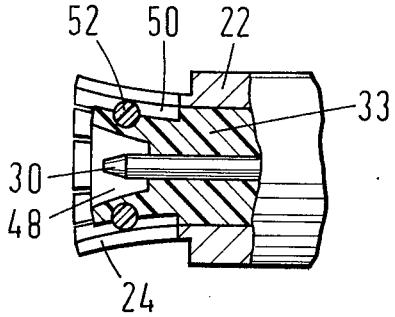
FIG. 3 is another embodiment of a pin member which fits the socket member according to FIG. 1.
Figure 4:
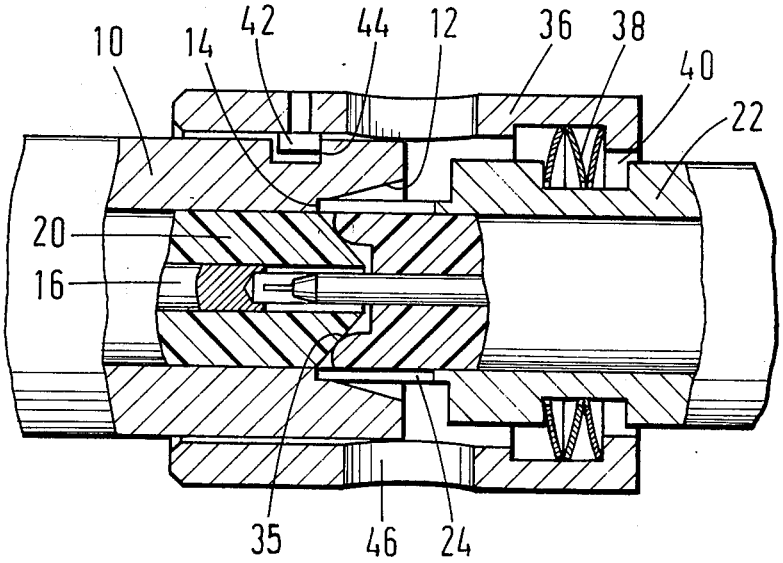
FIG. 4 shows a coaxial plug-type connection constructed according to the invention in the plugged-in and sealed state.

The outer conductor 22 of the pin plugs illustrated in FIGS. 2 and 3 carries a contact pin which consists of outwardly spreading spring segments 24 and which on plugging together is compressed via the cone 12 so that its front end contact annular face 26 comes into contact with the contact step 14. The inner conductor 28 of the pin member is provided in conventional manner with a conical end portion 30. the dielectric 32 between the outer conductor 22 and the inner conductor 28 continues forwardly almost to the end annular face 26 of the contact segments but carries a centre recess 34 which runs round the end 30 of the inner conductor with a front sealing bead 36, the shape being selected in accordance with the specific properties of the materials used, in particular as regards the compressibility of the material, in such a manner that in the plugged-in state a permanent and adequate sealing pressure is ensured at the sealing point 35 (FIG. 4). FIG. 4 shows two plug members fitted together according to FIGS. 1 and 2 and illustrates the deformation which takes place to provide the sealing. The resulting pressure or the propagation of the pressure also provides a sealing with respect to the outer conductor in such a manner that practically no foreign bodies can penetrate. The only possibility of moisture penetrating is between the slits of the spring segments 24 or via the contact end annular faces and this amount is so slight that the impairment of the electrical properties is of no significance.

In the example of embodiment according to FIG. 4 for the axial fixing of the two plug members a bayonet coupling sleeve 36 is provided which is supported via a ring 38 with axial resiliency which engages in a groove 40 of the outer conductor 22 of the pin member. The bayonet coupling sleeve 36 engages with fingers 42 in corresponding slots 44 of the outer conductor 10 of the socket member. In the end region of the outer conductor the bayonet coupling sleeve 36 comprises cleaning holes 46 which are distributed over the periphery and through which the penetrating water or penetrating dirt can be easily removed or washed out. Any moisture which has penetrated can also dry out and evaporate through these holes.

In the example of embodiment according to FIG. 3 the dielectric 33 comprises an outwardly widening portion 48 which exposes the end 30 of the inner conductor and is provided in the region of the spring segments 24 furthermore with an outer annular recess 50 which is supported by a ring 52 which consists of elastomeric material and engages in an outer groove of the dielectric.

In the pin member according to FIG. 2 the dielectric 32 consists of an elastomeric material whereas in the example of embodiment according to FIG. 3 only the sealing ring 52 is made from such a material.

The manipulating bosses are formed in grip manner similar to a water-tap. The bayonet or screw sleeve projects at least by half its front internal diameter beyond the plug point 3 or more bayonet bosses are provided.

The angle which the end face of the dielectric makes with the axis is greater than 15° and the elastomeric insulator at the cable plug serves simultaneously for sealing in the direction of the cable. Externally of the outer conductor an additional sealing ring is provided.

Figure 5:
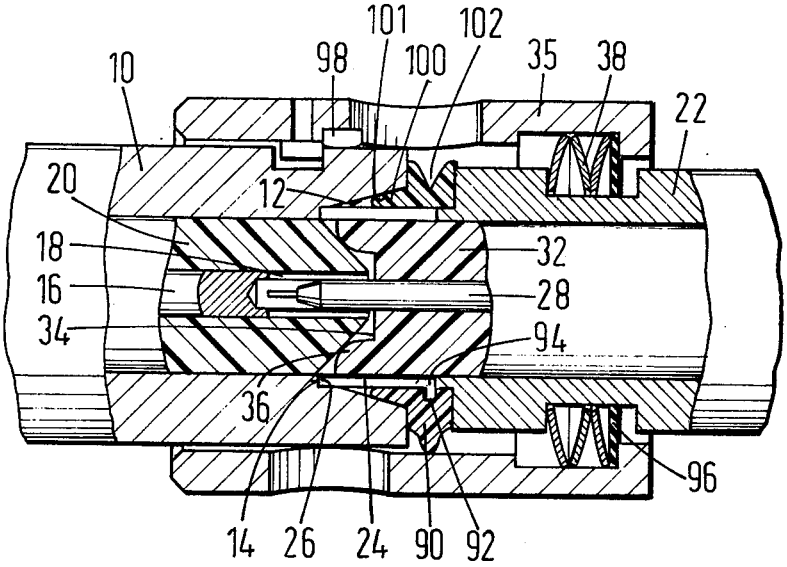
FIG. 5 is a sectional view of the plug-type connection corresponding to FIG. 4 in the plugged-in and sealed state.

In the example of embodiment according to FIG. 5 an additional seal is provided at the outer conductor.

Inserted between the two end annular surfaces of the outer conductors 10 and 22 is a resilient ring 100 which has a conical extension 101 with which it engages into the conical gap between the widened portion 12 and the contact socket 24, thus preventing outward squeezing.

According to the example of embodiment of FIG. 5 the ring 100 is provided along the centre line with an encircling V-shaped recess 102 which permits better deformation in the axial direction. In the example of embodiment according to FIG. 5 at the bottom the ring 100 is provided with an outwardly projecting sealing lip 90 which provides a sealing with respect to the bayonet sleeve 35. Furthermore, as also illustrated at the bottom of FIG. 5 the ring 100 may have an inner groove 92 into which annular rib portions of the spring tongues of the contact socket can engage to secure against axial displacement.

According to a further embodiment of the invention the spring washers 38 are supported via a sealing ring 96 to prevent penetration of dirt from this side.

According to a further feature of the invention the bayonet sleeve may be provided internally with a recess 98 to permit explusion of clay-like soiling.

Figure 6:
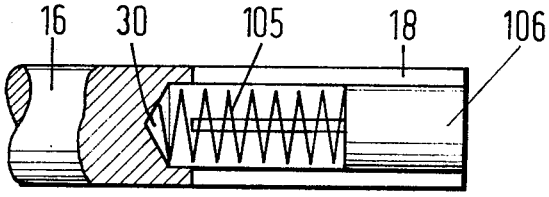
FIG. 6 shows to a larger scale a view of the inner conductor socket of the one plug member.

FIG. 6 shows a resilient inner conductor socket 18 which surrounds a helical pressure spring 105 which supports a stopper 106 which is made from metal or plastic and which in the unplugged state protects the inner conductor socket against penetration of foreign bodies. On insertion of the plug the inner conductor 30 of the other plug member pushes the resilient stopper 106 back so that the radial resiliency of the socket is released and contacting with the inner conductor pin effected.

Figure 7:
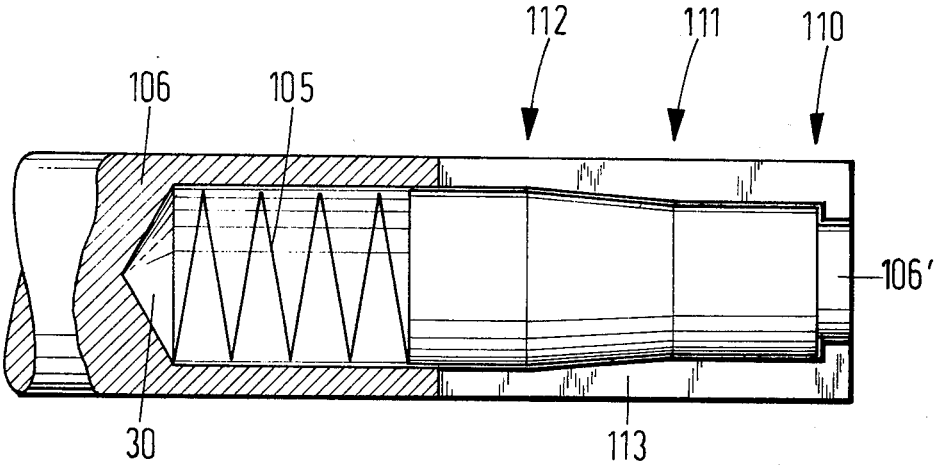
FIG. 7 shows another embodiment of the inner conductor socket to a larger scale.

FIG. 7 shows a further embodiment of an inner conductor socket comprising a stopper 106'. The inner conductor contact segments are provided in the front region with a shoulder 110 which ensures contacting at the end and simultaneously serves as positive stop for the stopper 106' provided with a corresponding abutment annular face.

According to the example of embodiment illustrated the spring segments extend between the points designated by 111 and 112 conically so that on compression of the stopper 106' the spring segments 113 can yield inwardly to come into contact with the inner conductor pin 30 of the plug.

The stopper 106' has an axial length which is such that it completely covers the slits between the segments and prevents the penetration of foreign bodies into the spring compartment. The stopper 106' is adapted to the inner form of the entire socket body. The conically widened portion may also be replaced by a step-shaped widened portion.

Figure 8:
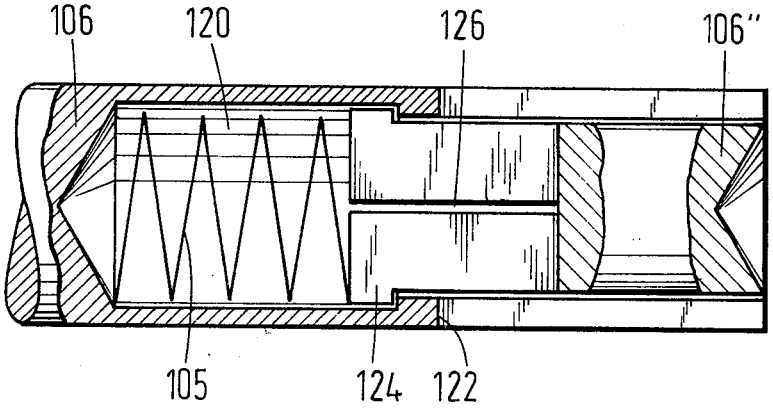
FIG. 8 is a further embodiment of the inner conductor socket.

FIG. 8 shows a further development of an inner conductor socket which is provided in the rear region with a portion of enlarged internal diameter 120 behind the inner collar 122 of which bears an annular flange 124 of a stopper 106''. Said stopper thus extends inwardly over the base of the socket slit where it is supported by the spring 105. To enable said stopper to be introduced into the enlarged portion 120 it is provided with an axial cross slit 126 so that it can be compressed on insertion and after passing the shoulder 122 returns resiliently to its original form. In the outer portion the stopper 106'' may be conically countersunk at 126 to facilitate introduction of the inner conductor pin 28 and the returning of the stopper 106''.

I claim:

1. Sealed coaxial plug type connection, comprising:

a separate plug section and a separate socket section; each said section comprising an inner conductor, a coaxial outer conductor around said inner conductor and a layer of dielectric material between said inner and outer conductors; in said plug section, its said inner conductor terminates at a free end, and a plug-in pin being formed at that said free end; in said socket section, its said inner conductor terminating at a free end and a pin receiving socket means formed at that said socket section free end;

a first one of said plug and said socket sections supporting resilient fingers that project from that said first section toward the other, said second section, and said fingers extending over and past the first of said free ends which is said free end of said inner conductor of said first section; said fingers being so shaped and positioned as to be capable of being deflected radially inwardly toward said inner conductor, and said fingers being normally biased radially outwardly of said inner conductor;

said dielectric material layer of said first section, which is the first of said dielectric material layers, being normally in engagement with and being deflectable with said fingers of said first section; in the vicinity of said first free end, said first dielectric material layer being so shaped as to be spaced from said inner conductor, thereby to permit the deflection of said first dielectric material layer along with said fingers therof;

said dielectric material layer of said second section, which is the second of said dielectric material layers, being positioned and shaped such that, with said plug in pin in said socket means, said first dielectric layer is deflectable to abut against said second dielectric layer;

said second section having a sleeve projecting toward said first section and projecting beyond the second of said free ends, which is said free end of said inner conductor of said second section; said sleeve having an opening therein leading from the end of said sleeve beyond said second free end back toward said second free end and said sleeve opening being defined by internal walls that taper gradually narrower moving toward said second free end; said sleeve opening being of a width such that said fingers can be moved therein and such that as said first and said second sections are moved together, said fingers are deflected radially inwardly by said sleeve opening internal walls for causing engagement of said first and second dielectric layers.

2. Sealed coaxial plug type connection of claim 1, wherein said second dielectric layer has a front surface facing toward said first section and said front surface tapers from a narrower width to a wider width moving along said second section away from said second free end.

3. Sealed coaxial plug type connection of claim 2, wherein said fingers of said first section and said sleeve of said section are both part of and extend from and complete said outer conductor.

4. Sealed coaxial plug type connection of claim 3, further comprising a coupling sleeve surrounding said outer conductor at the junction between said conductor sections, and means in both said conductor sections for joining with said coupling sleeve, such that said coupling sleeve holds said conductor sections together.

5. Sealed coaxial plug type connection of claim 4, further comprising apertures through said coupling sleeve near said junction therebetween for access to said conductor sections therethrough.

6. Sealed coaxial plug type connection of claim 4, further comprising a spring washer around and secured to one said conductor section and in engagement with said coupling sleeve so as to normally bias said coupling sleeve toward that one said section and away from the other said section of said plug type connection; a receiving groove in the other said section of said plug type connection and a projection from said coupling sleeve into said receiving groove for holding said coupling sleeve in position against said plug type connection under the influence of the bias of said spring washer.

7. Sealed coaxial plug type connection of claim 2, wherein said second dielectric material layer front surface is tapered at an angle with respect to the axis of said inner conductor that is greater than 15°.

8. Sealed coaxial plug type connection of claim 1, wherein said first section has said plug-in pin and said second section has said socket means.

9. Sealed coaxial plug-type connection of claim 1, further comprising a ring of elastomeric material positioned around said first dielectric material layer and between that said layer and said fingers for biasing said fingers normally radially outwardly.

10. Sealed coaxial plug type connection of claim 1, further comprising a sealing bead on the internal surface of said first dielectric material layer; said bead being positioned such that said bead is the first portion of said first dielectric material layer that is squeezed against said second dielectric material layer.

11. Sealed coaxial plug type connection of claim 1, wherein said fingers of said first section and said sleeve of said second section are both part of and extend from and complete said outer conductor;

a ring of resilient material disposed in said sleeve opening and being located radially outside of said fingers when said fingers are in said sleeve opening and said plug in pin and said socket means are engaged; said ring being compressed axially between said sleeve and said outer conductor portion of said first section.

12. Sealed coaxial plug type connection of claim 11, wherein said ring includes a generally conically shaped section that is shaped to extend into and to engage the said sleeve opening along the length of said tapering internal wall of said sleeve opening and to engage along said fingers.

13. Sealed coaxial plug type connection of claim 12, wherein said resilient ring has an external, encircling V-shaped groove therein.

14. Sealed coaxial plug type connection of claim 11, wherein said ring has an inner periphery facing toward and in engagement with the external periphery of said fingers; an annular groove around said inner periphery of said ring; a correspondingly shaped annular rib around said external periphery of said fingers and in said annular groove of said ring.

15. Sealed coaxial plug type connection of claim 1, wherein said socket means comprises a sheath and a shiftable stopper sealingly fitted in and movable through said sheath; means for biasing said stopper out of said sheath and out of said second free end; said stopper being so located as to be engaged and then shifted through its said sheath by said plug in pin when said plug in pin and said socket means are brought together.

16. Sealed coaxial plug type connection of claim 15, further comprising a stop in said sheath and positioned to engage and block said stopper as said stopper is biased out of said sheath.

17. Sealed coaxial plug type connection of claim 16, wherein said sheath of said socket means comprises a plurality of annularly arrayed, axially extending socket means fingers that are normally biased radially inwardly; said stopper being of a length sufficient to extend the full length of said socket means fingers.

18. Sealed coaxial plug type connection of claim 17, wherein the interiors of said socket means fingers taper conically wider away from said second section free end and the exterior of said stopper correspondingly tapers in shape to engage said interiors of said socket means fingers.

19. Sealed coaxial plug type connection of claim 16, wherein said stopper includes an annular flange and said stop comprises a shoulder in said sheath against which said flange moves.

* * * * *